US012453447B2

(12) United States Patent
Arndt et al.

(10) Patent No.: US 12,453,447 B2
(45) Date of Patent: Oct. 28, 2025

(54) TOILET SEAT ASSEMBLY

(71) Applicant: Bemis Manufacturing Company, Sheboygan Falls, WI (US)

(72) Inventors: Jonathan Arndt, Sheboygan, WI (US); Keith Fischer, Elkhart Lake, WI (US)

(73) Assignee: Bemis Manufacturing Company, Sheboygan Falls, WI (US)

( * ) Notice: Subject to any disclaimer, the term of this patent is extended or adjusted under 35 U.S.C. 154(b) by 288 days.

(21) Appl. No.: 18/192,278

(22) Filed: Mar. 29, 2023

(65) Prior Publication Data

US 2023/0233042 A1 Jul. 27, 2023

Related U.S. Application Data

(63) Continuation-in-part of application No. 29/813,742, filed on Nov. 1, 2021, now Pat. No. Des. 1,001,985.

(51) Int. Cl.

| | |
|---|---|
| ***A47K 13/10*** | (2006.01) |
| ***A47K 13/02*** | (2006.01) |
| ***A47K 13/12*** | (2006.01) |

(52) U.S. Cl.

CPC ..... *A47K 13/105* (2013.01); *A47K 13/02* (2013.01); *A47K 13/12* (2013.01)

(58) Field of Classification Search

CPC ..... A47K 13/105; A47K 13/02; A47K 13/12; A47K 17/026

(Continued)

(56) References Cited

U.S. PATENT DOCUMENTS

| | | | |
|---|---|---|---|
| 2,086,211 | A | 7/1937 | Campbell |
| 2,539,481 | A | 1/1951 | Rosenheim |

(Continued)

FOREIGN PATENT DOCUMENTS

| | | | |
|---|---|---|---|
| CA | 2220561 | A | 5/1998 |
| CN | 205531877 | U | 8/2016 |

(Continued)

OTHER PUBLICATIONS

Bemis Assist Toilet Seat, posted Oct. 12, 2023 [online], [retrieved Oct. 30, 2024]. Retrieved from internet,https://www.amazon.com/Bemis-Assist-Support-Handles-Elongated/dp/BOCKY3551 N/ref=cm_cr_arp_d_product_top?ie=UTF8&th=1 (Year: 2023).

(Continued)

*Primary Examiner* — Lori L Baker
(74) *Attorney, Agent, or Firm* — Michael Best & Friedrich LLP

(57) ABSTRACT

A toilet seat assembly is for a toilet and includes a hinge post configured to be coupled to the toilet, and a toilet seat rotatably coupled to the hinge post and defining a bottom surface. The toilet seat includes a ring having a support surface opposite the bottom surface and configured to support a person when sitting on the toilet, a first wing extending from a first side of the ring, and a second wing extending from a second side of the ring opposite the first side. The toilet seat assembly further includes a first handle extending upwardly from the first wing and oriented perpendicularly relative to the bottom surface of the toilet seat, and a second handle extending upwardly from the second wing and oriented perpendicularly relative to the bottom surface of the toilet seat. The first and second handles are configured to be gripped by the person.

19 Claims, 7 Drawing Sheets

(58) Field of Classification Search
USPC ..... 4/241, 236, 237; 16/221
See application file for complete search history.

(56) References Cited

U.S. PATENT DOCUMENTS 2,774,975 A * 12/1956 Frank ..... A47K 17/026 297/411.2
3,116,527 A 1/1964 Springer
D212,327 S 10/1968 Brewer
3,405,411 A * 10/1968 Brown ..... A47K 17/02 4/254
3,574,242 A 4/1971 Trowbridge
3,594,831 A 7/1971 Brewer
3,905,051 A * 9/1975 Gozdziewski ..... A47C 15/004 4/240
3,988,789 A 11/1976 Blount
4,087,884 A 5/1978 Seiderman
4,168,552 A 9/1979 Austin
4,318,213 A 3/1982 Blount
4,776,631 A * 10/1988 Sargent ..... B60R 15/04 4/300
4,817,242 A 4/1989 Rapp
4,944,048 A * 7/1990 Sargent ..... B60R 15/04 4/323
5,095,556 A * 3/1992 Franey ..... A47K 17/026 4/483
5,303,429 A 4/1994 Notzold
5,361,423 A 11/1994 Notzold
5,373,591 A * 12/1994 Myers ..... A47K 3/122 4/578.1
5,570,479 A 11/1996 Chomik et al.
5,592,703 A * 1/1997 Jones ..... A61G 7/1007 297/DIG. 10
D387,421 S 12/1997 Kivela
D397,426 S 8/1998 Woods
6,154,892 A 12/2000 Hogue
6,161,229 A * 12/2000 Ryan ..... A61G 7/1017 297/DIG. 10
6,189,160 B1 * 2/2001 Pettus ..... A47K 13/10 4/246.1
6,192,527 B1 * 2/2001 Paul ..... E03D 11/025 4/420.4
6,263,516 B1 7/2001 Pedersen et al.
6,347,415 B1 2/2002 Hogue
6,353,941 B1 3/2002 Manning et al.
6,408,447 B1 * 6/2002 Burbank ..... A47K 13/24 4/300.3
6,418,672 B1 * 7/2002 Hampel ..... E04H 1/1216 52/79.5
6,640,349 B2 11/2003 Toldo et al.
6,751,826 B2 6/2004 Miller
6,857,138 B2 * 2/2005 Moser ..... A47K 13/005 4/237
6,904,622 B1 * 6/2005 Gabriel ..... A47K 13/005 4/237
7,073,210 B2 7/2006 Jiang
7,093,308 B2 * 8/2006 Berlovan ..... A47K 17/026 4/240
7,146,655 B2 * 12/2006 Karnopp ..... A47K 13/24 4/239
7,240,377 B2 * 7/2007 Vanden Heuvel ..... A47K 13/12 4/237
7,987,529 B1 * 8/2011 Wise ..... E03D 11/04 4/905
8,087,103 B2 1/2012 Leibfried
8,214,931 B2 7/2012 Bemis et al.
8,402,572 B2 * 3/2013 Herasimtschuk .... A47K 17/026 4/578.1
8,763,169 B2 * 7/2014 Daniels ..... A47K 13/005 4/240
D733,851 S 7/2015 Stelter et al.
9,107,548 B2 8/2015 Hand et al.
9,321,897 B2 4/2016 Kabeya et al.
9,422,703 B1 8/2016 Ciotic
9,486,119 B2 11/2016 Laundre
9,635,987 B2 5/2017 Hand et al.
9,848,744 B1 * 12/2017 Hobbs ..... A47K 13/005
9,918,599 B1 3/2018 Bensimon
10,188,246 B1 1/2019 Ciotic
D865,501 S * 11/2019 Bodman ..... D8/374
D880,665 S 4/2020 Pomplun et al.
D882,051 S 4/2020 Armstrong
11,324,363 B2 5/2022 Pomplun et al.
D974,815 S * 1/2023 Bodman ..... D6/716.1
11,596,279 B2 * 3/2023 Bodman ..... A47K 11/04
11,717,119 B2 * 8/2023 Van Varick ..... A47K 11/04 4/483
D1,001,985 S 10/2023 Arndt
11,800,958 B2 * 10/2023 Henne ..... A47K 13/26
2004/0025234 A1 2/2004 Moser et al.
2004/0154085 A1 * 8/2004 Berlovan ..... A47K 17/026 4/237
2005/0076426 A1 * 4/2005 Battiston ..... A47K 11/04 4/483
2005/0183193 A1 * 8/2005 Karnopp ..... A47K 17/00 4/254
2005/0283886 A1 * 12/2005 Vanden Heuvel ..... A47K 13/12 4/237
2006/0156459 A1 7/2006 Hsu
2007/0250996 A1 11/2007 Li
2009/0193569 A1 8/2009 Leibfried
2011/0004989 A1 * 1/2011 Herasimtschuk .... A47K 17/026 4/254
2012/0240318 A1 9/2012 Sims
2013/0139311 A1 * 6/2013 Shaw ..... A47K 11/02 4/479
2014/0223652 A1 8/2014 Jin et al.
2016/0235263 A1 8/2016 Du et al.
2018/0084959 A1 3/2018 Hall et al.
2020/0077848 A1 3/2020 Pomplun et al.
2020/0107681 A1 4/2020 Laundre
2020/0375416 A1 12/2020 Hand et al.
2021/0113035 A1 4/2021 Hand et al.
2021/0345842 A1 11/2021 Savioli et al.
2023/0233042 A1 * 7/2023 Arndt ..... A47K 13/105 4/240
2024/0335070 A1 * 10/2024 Siddens ..... A47K 13/02

FOREIGN PATENT DOCUMENTS

CN 308670800 6/2024
EP 1813179 A2 8/2007
FR 2364642 A1 4/1978
GB 443929 A 3/1936
GB 447101 A 5/1936
GB 692276 A 6/1953
GB 2389144 B 4/2004
GB 2573540 A 11/2019
GB 6205774 5/2022
JP 2000157450 A 6/2000
KR 200284887 Y1 8/2002
KR 20110035637 A 4/2011
KR 20110139833 A 12/2011
WO WO-2004045352 A2 * 6/2004 ..... A47K 13/005

OTHER PUBLICATIONS

Bemis Independence Assist, posted 2024 [online], [retrieved Oct. 30, 2024]. Retrieved from internet, https:// www.toiletseats.com/p/assist-standard-height-premium-toilet-seat-support-arms/?gad_source=1&gelid=EAIaIQobChMI8JvO9a20iQMVRTYIBROFVTewEAQYAiABEgIoIvD_BWE (Year: 2024).
HD Bemis Assist Elongated, posted Apr. 3, 2024 [online], [retrieved Oct. 30, 2024]. Retrieved from internet, https:// www.homedepot.com/p/BEMIS-Assist-Elongated-Round-Standard-Height-Premium-Plastic-Closed-Front-Toilet-Seat-in-White-with-Support-Arms-A8AS100-000/328055911 (Year: 2024).
Toilet Seats dot com Bemis to Launch, posted Jan. 2023 [online], [retrieved Oct. 30, 2024]. Retrieved from internet, https://www.

(56) References Cited

OTHER PUBLICATIONS toiletseats.com/press-room/press-releases/bemis-to-launch-assist-premium-seat-that-eliminates-need-for-wall-mounted-rails/ (Year: 2023).

* cited by examiner

TOILET SEAT ASSEMBLY

CROSS-REFERENCE TO RELATED APPLICATIONS

This application is a continuation-in-part of co-pending U.S. Design Pat. application No. 29/813,742 filed on Nov. 1, 2021, the entire contents of which are incorporated herein by reference.

SUMMARY OF THE DISCLOSURE

The present disclosure relates to toilet seat assemblies, and more particularly to non-elevated toilet seat assemblies that assist in helping a person to sit down on and stand up from a toilet.

The present invention provides, in one aspect, a toilet seat assembly for a toilet. The toilet seat assembly includes a hinge post configured to be coupled to the toilet, and a toilet seat rotatably coupled to the hinge post and defining a bottom surface that is configured to face the toilet. The toilet seat includes a ring having a support surface opposite the bottom surface and configured to support a person when sitting on the toilet, a first wing extending from a first side of the ring, and a second wing extending from a second side of the ring opposite the first side. The toilet seat assembly further includes a first handle extending upwardly from the first wing and oriented perpendicularly relative to the bottom surface of the toilet seat and a second handle extending upwardly from the second wing and oriented perpendicularly relative to the bottom surface of the toilet seat. The first and second handles are configured to be gripped by the person.

The present invention provides, in another aspect, a toilet seat assembly for a toilet. The toilet seat assembly includes a hinge post configured to be coupled to the toilet and a toilet seat rotatably coupled to the hinge post and defining a bottom surface that is configured to face the toilet. The toilet seat includes a ring having a support surface opposite the bottom surface and configured to support a person when sitting on the toilet, an outer perimeter, and an inner perimeter defining an opening. The toilet seat assembly further includes a first wing integrally formed with the ring and extending from the outer perimeter of the ring on a first side of the ring, and a second wing integrally formed with the ring and extending from the outer perimeter of the ring on a second side of the ring opposite the first side. Moreover, the toilet seat assembly includes a first handle coupled to the first wing and configured to be gripped by the person, a second handle coupled to the second wing and configured to be gripped by the person, and a plurality of ribs formed on the bottom surface of the toilet seat to provide support to the toilet seat.

The present invention provides, in another aspect, a toilet seat assembly for a toilet. The toilet seat assembly includes a hinge post configured to be coupled to the toilet and a toilet seat rotatably coupled to the hinge post and defining a bottom surface that is configured to face the toilet. The toilet seat includes a ring having a support surface opposite the bottom surface and configured to support a person when sitting on the toilet, a first wing extending from a first side of the ring, and a second wing extending from a second side of the ring. The first wing has a rear portion adjacent the hinge post and a front portion opposite the rear portion. The second wing has a rear portion adjacent to the hinge post and a front portion opposite the rear portion. Moreover, the toilet seat assembly includes a first handle coupled to the first wing and configured to be gripped by a person, and a second handle coupled to the second wing and configured to be gripped by the person. At least a portion of the first handle extends beyond the front portion the first wing. At least a portion of the second handle extends beyond the front portion of the second wing.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings. Terms of degree, such as "substantially" or "approximately" are understood by those of ordinary skill to refer to reasonable ranges outside of the given value, for example, general tolerances associated with manufacturing, assembly, and use of the described embodiments.

DETAILED DESCRIPTION

Figure 3:
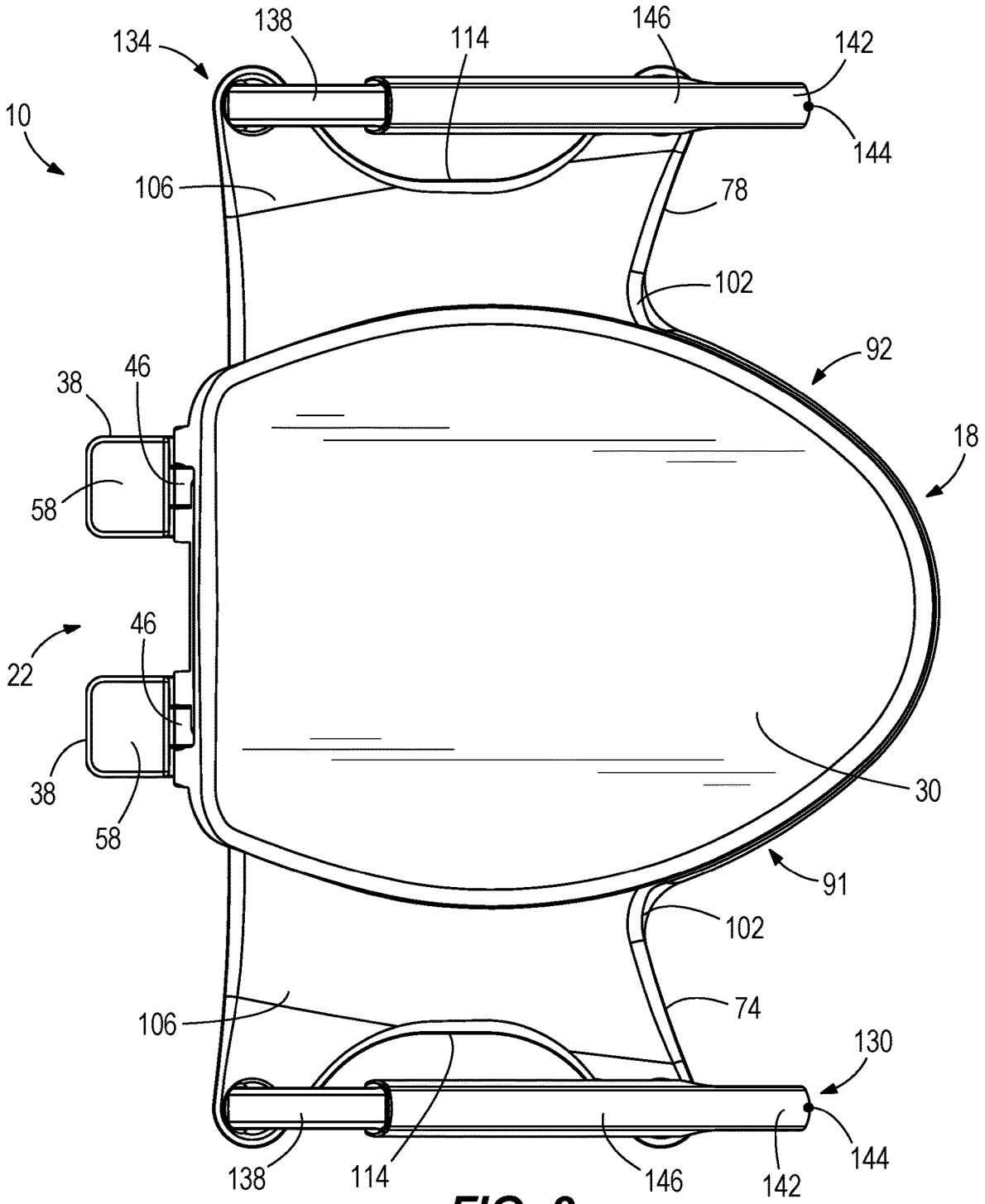
FIG. 3 is a top view of the toilet seat assembly of FIG. 1.
Figure 4:
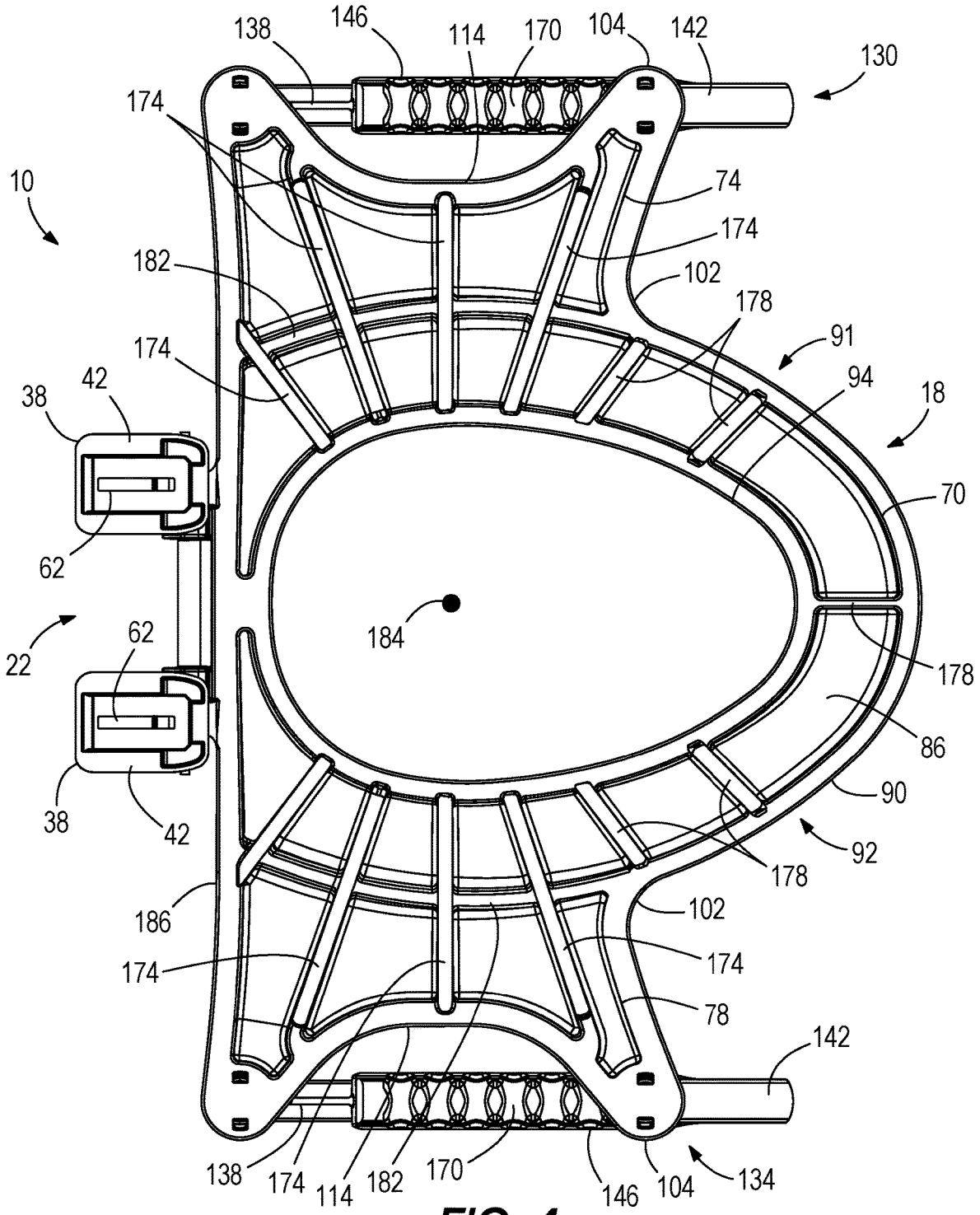
FIG. 4 is a bottom view of the toilet seat assembly of FIG. 1.
Figure 5:
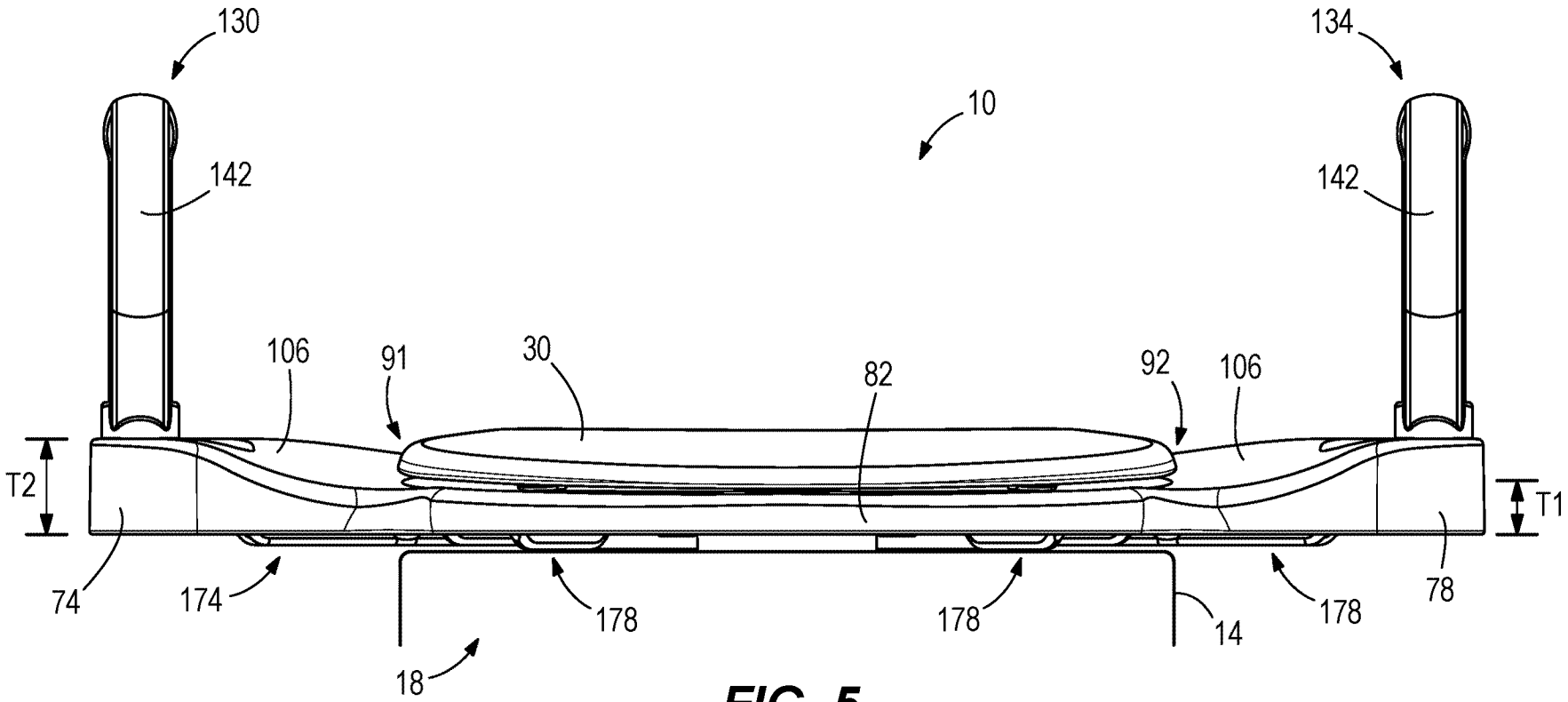
FIG. 5 is a front-side view of the toilet seat assembly of FIG. 1.

FIGS. 1-5 illustrate a toilet seat assembly 10. The toilet seat assembly 10 is configured to be pivotably coupled to a toilet 14 (FIG. 5). The illustrated toilet seat assembly 10 may also be referred to as a non-elevated toilet seat assembly 10. The toilet seat assembly 10 includes a toilet seat 18 pivotably coupled to the toilet 14 by a hinge post 22. The hinge post 22 allows the toilet seat 18 to pivot about a hinge axis 26 (FIG. 2) between a first position and a second position. The first position is a raised or upright position. The second position is a lowered or in-use position when the toilet seat 18 is configured to engage a surface of the toilet 14. The toilet seat assembly 10 further includes a lid 30 pivotably coupled to the toilet seat 18 by the hinge post 22, such that the lid 30 is configured to pivot about the hinge axis 26 between a closed position and an open position. In the closed position, the lid 30 engages and covers the toilet seat 18. In the open position, the lid 30 disengages and is spaced from the toilet seat 18.

Figure 2:
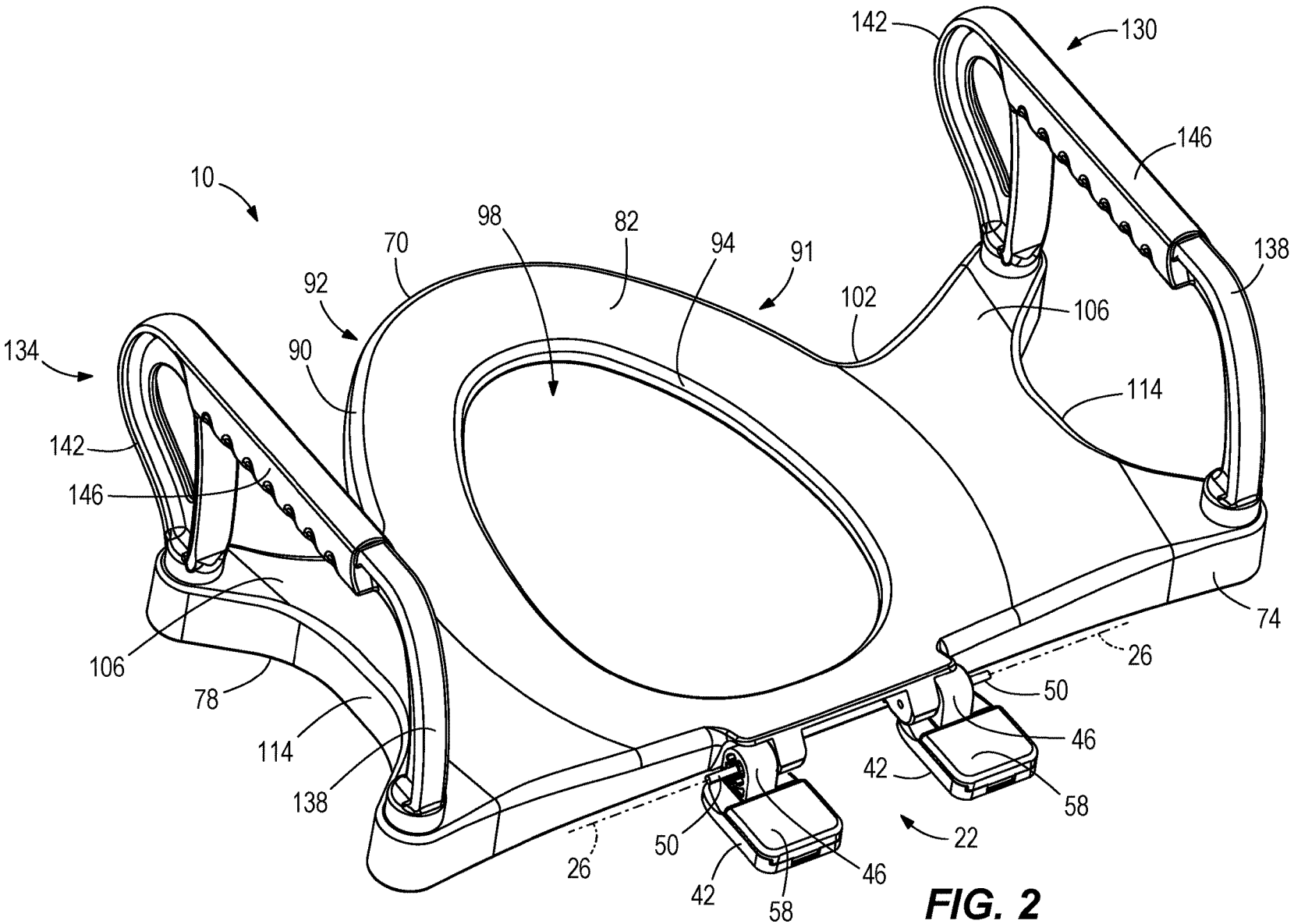
FIG. 2 is a rear perspective view of the toilet seat assembly of FIG. 1, the toilet seat assembly is illustrated without a lid.
Figure 6:
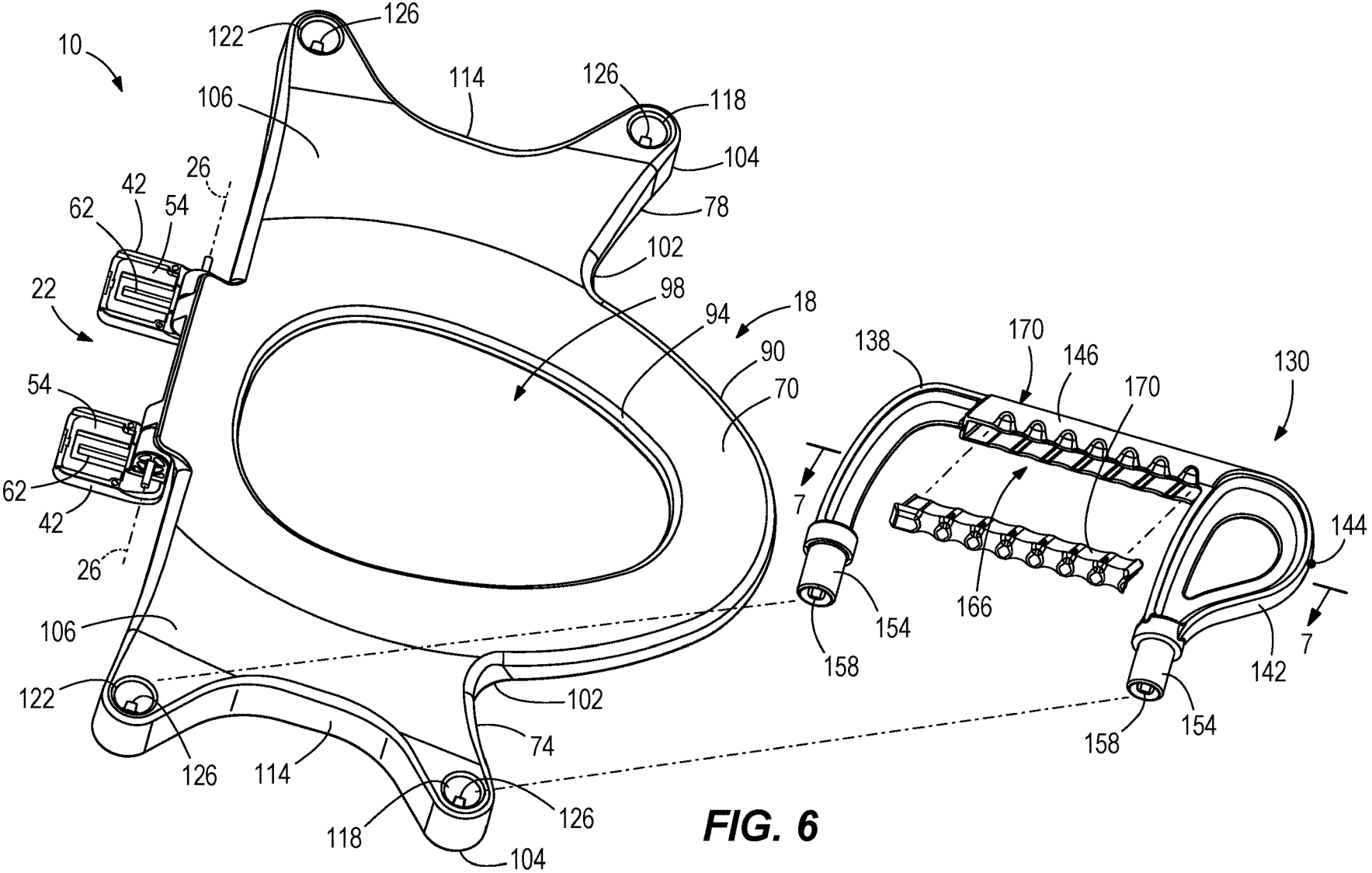
FIG. 6 is an exploded view of the toilet seat assembly of FIG. 1, with portions of the toilet seat assembly removed.

In reference to FIGS. 2, 4, and 6, the hinge post 22 includes two post members 38 configured to be coupled to the toilet 14. Each post member 38 includes a base 42 with an upright portion 46 coupled to the toilet seat 18 and the lid 30 via a pin 50 that defines the hinge axis 26. Each post member 38 further includes a plate 54 and a cover 58 coupled to the base 42. The plate 54 is disposed within the base 42 and includes an elongated aperture 62 (e.g., elongated slot). To couple the post members 38 to the toilet 14, a pair of fasteners are respectively inserted through the elongated apertures 62 and into mounting apertures that extend through the toilet 14. The elongated apertures 62 allow the position of the toilet seat assembly 10 to be adjusted relative to the toilet 14. As such, the post members 38 may slide relative to the toilet 14 in a direction perpendicular to the hinge axis 26 before the fasteners are fully tightened to fix the post members 38 to the toilet 14.

With reference to FIGS. 1-5, the illustrated toilet seat 18 includes a ring 70, a first wing 74 coupled to the ring 70, and a second wing 78 also coupled to the ring 70. Specifically, the first wing 74 extends from a first side 91 of the ring 70 and the second wing 78 extends from a second side 92 of the ring 70 opposite the first side 91. That said, the first and second wings 74, 78 are connected to the ring 70 along junctures 102. In the illustrated embodiment, the first and second wings 74, 78 are integrally formed (e.g., molded) with the ring 70. In other embodiments, the first and second wings 74, 78 may be separate pieces that are secured to the ring 70. The toilet seat 18 includes a bottom surface 86 that faces the toilet 14. The bottom surface 86 is flat or planar. Also, the ring 70 has a support surface 82 opposite the bottom surface 86 and configured to support a person sitting on the toilet seat assembly 10. The ring 70 further includes an outer perimeter 90 (e.g., outer edge) defined between the support surface 82 and the bottom surface 86, and an inner perimeter 94 (e.g., inner edge) defined between the support surface 82 and the bottom surface 86. The inner perimeter 94 defines an opening 98. In addition, the toilet seat 18 is formed of a first material. In the illustrated embodiment, the first material is a plastic, while in other embodiments, the first material is some other suitable material.

In reference to FIGS. 4 and 6, the first and second wings 74, 78 are identical in structure and each has an outer edge 104 defined between a top surface 106 and the bottom surface 86. The outer edge 104 of each wing 74, 78 has a curved surface 114 spaced away from the ring 70. Each wing 74, 78 further includes a first bore 118 and a second bore 122 extending into the first and second wings 74, 78. The first bore 118 is disposed at the front portion of the toilet seat assembly 10 and the second bore 122 is disposed at a rear portion of the toilet seat assembly 10 that is adjacent the hinge post 22. Each bore 118, 122 includes a pair of recesses 126 (only one of which is shown in FIG. 6).

In reference to FIG. 5, the ring 70 of the toilet seat 18 defines a ring thickness T1 extending between the support surface 82 of the ring 70 and the bottom surface 86 of the toilet seat 18 proximate the outer perimeter 90 of the ring 70. The first and second wings 74, 78 each define a wing thickness T2 extending between the top surface 106 of each wing 74, 78 and the bottom surface 86 proximate the outer edge 104. At the juncture 102, the ring thickness T1 is substantially equal to the wing thickness T2. In addition, the wing thickness T2 of each wing 74, 78 increases in a direction extending away from the ring 70 of the toilet seat 18 to increase the amount of material used to form the first and second wings 74, 78. As such, a maximum wing thickness T2 of each wing 74, 78 is greater than a maximum ring thickness T1 of the ring 70. The increase of the wing thickness T2 provides structural strength to the first and second wings 74, 78.

Figure 1:
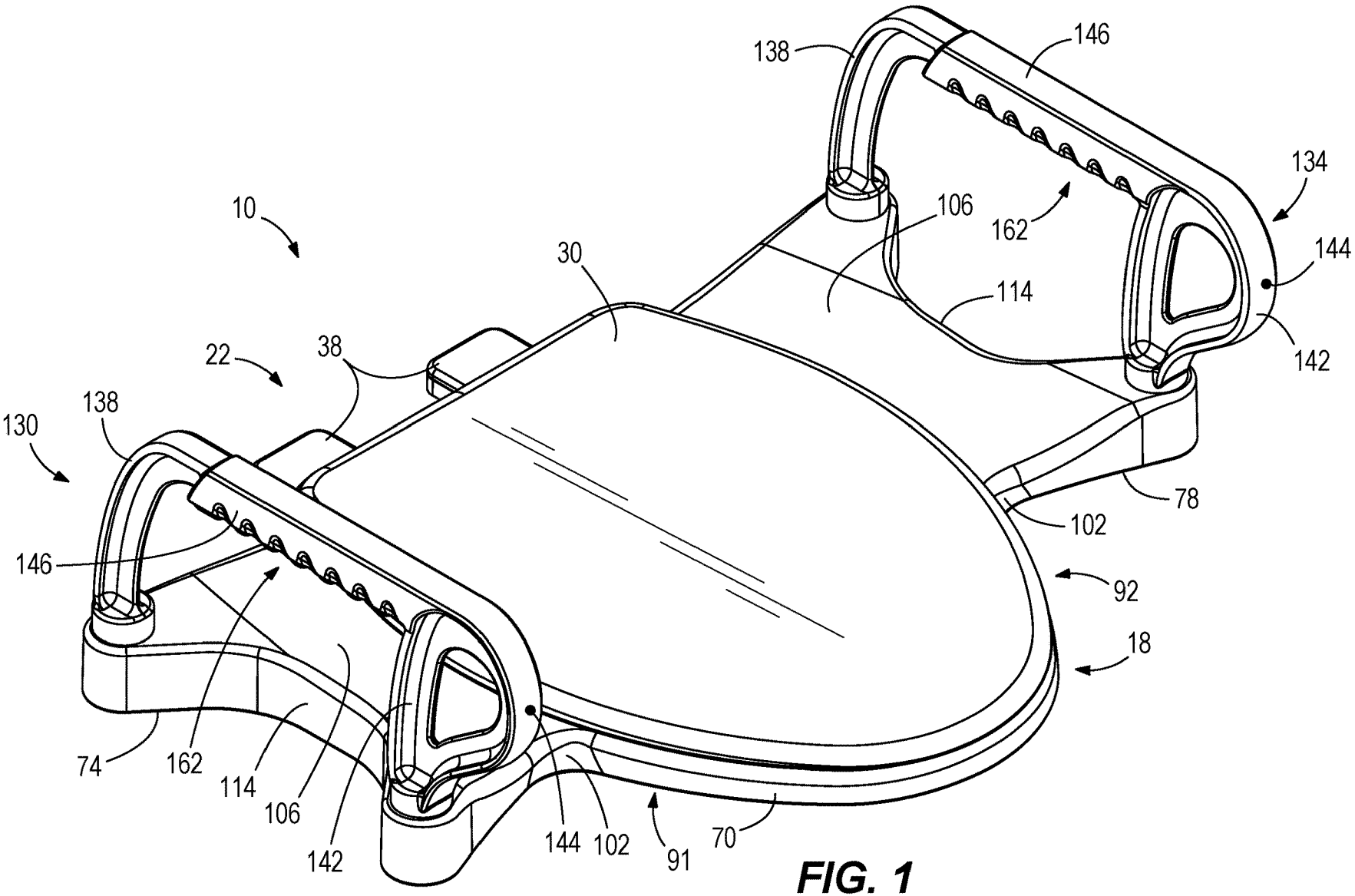
FIG. 1 is a front perspective view of a toilet seat assembly according to an embodiment of the present invention.

In reference to FIGS. 1, 3, and 6, the toilet seat assembly 10 further includes a first handle 130 and a second handle 134. The illustrated handles 130, 134 are independent or separate components from the toilet seat 18. The first handle 130 is configured to be coupled to first wing 74, such that the first handle 130 is adjacent the first side 91 of the ring 70. The second handle 134 is configured to be coupled to the second wing 78, such that the second handle 134 is adjacent the second side 92 of the ring 70. The first and second handles 130, 134 extend perpendicular to the bottom surface 86. In the illustrated embodiment, the first and second handles 130, 134 are removably coupled to the toilet seat 18. In other embodiments, the first and second handles 130, 134 may be permanently coupled to the toilet seat 18.

Figure 7:
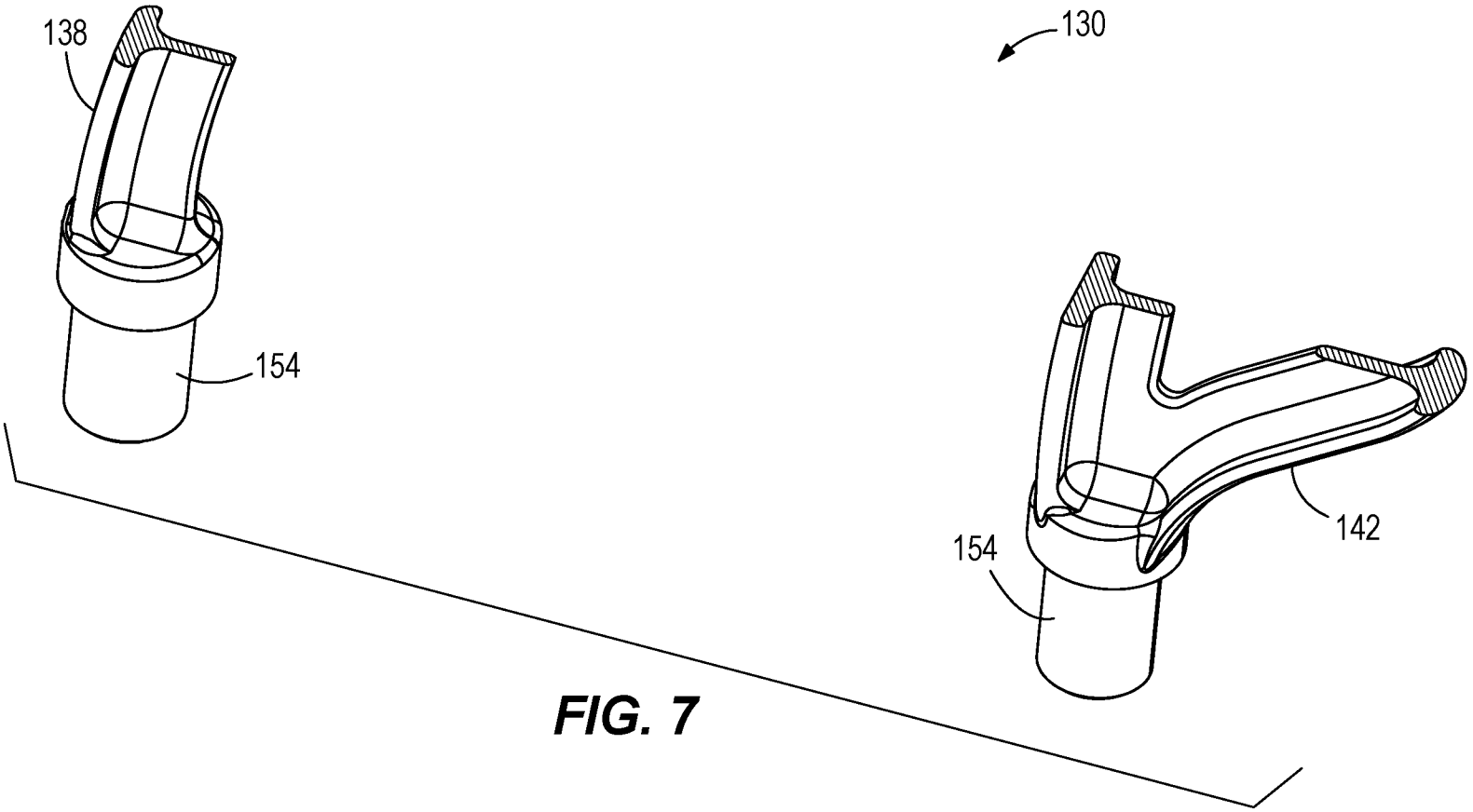
FIG. 7 is a cross-sectional view of a first handle of the toilet seat assembly of FIG. 6, taken along line 7-7 in FIG. 6.

The first and second handles 130, 134 are identical in structure. In the illustrated embodiment, each handle 130, 134 includes a first loop 138, a second loop 142, and a grip portion 146 disposed on the first loop 138. The second loop 142 includes a forwardmost point 144 that extends beyond a front portion of a corresponding wing 74, 78. The first and second handles 130, 134 each define a T-shaped cross-section (FIG. 7) outside the grip portion 146. In addition, the first and second handles 130, 134 are formed of a second material that is different from the first material (e.g., the material of the toilet seat 18). The second material may be more rigid than the first material. For example, the first material may be a homogenous plastic, while the second material may be a glass-filled plastic. In other embodiments, the second material may be some other suitable material.

The first and second handles 130, 134 each include two posts 154 (FIG. 6) that couple to the first and second bores 118, 122 via snap-fit mechanisms. Specifically, each post 154 includes a tab 158 configured to engage the recess 126 of the first and second bores 118, 122 when the first and second handles 130, 134 are coupled to the first and second wings 74, 78, respectively. In other embodiments, tabs 158 may be located in each bore 118, 122, while recesses 126 may be formed on each post 154. As such, each post 154 is configured to be respectively received within the first and second bores 118, 122 of each wing 74, 78, with the first loop 138 being disposed adjacent the rear portion of the toilet seat assembly 10 and the second loop 142 being disposed adjacent the front portion of the toilet seat assembly 10.

The grip portion 146 is integrally formed with the first and second handles 130, 134 and is configured to be gripped to assist the person in sitting down on the toilet seat 18 or standing up from the toilet seat 18. A plurality of indentations 162 (FIG. 1) are formed on and extend along a length of the grip portion 146. The illustrated grip portion 146 defines a cavity 166 configured to receive a gripping member 170 that extends along a bottom portion of the grip portion 146. The cavity 166 faces the top surface 106 of the first and second wings 74, 78.

The gripping member 170 may be formed of a third material that is different from the first material of the toilet seat 18 and the second material of the first and second handles 130, 134. The third material may be softer than the first material and the second material. In some embodiments, the third material may be rubber or elastomeric material. As such, the gripping member 170 provides a soft gripping surface for the person using the toilet seat assembly 10 as their hand wraps around the grip portion 146.

In reference to FIGS. 4 and 5, the illustrated toilet seat assembly 10 includes a first plurality of ribs 174 and a second plurality of ribs 178 formed along the toilet seat 18. The first plurality of ribs 174 is formed along the bottom surface 86 of the ring 70, such that the first plurality of ribs 174 extends continuously between the inner perimeter 94 of the ring 70 and the outer edge 104 of each wing 74, 78. In the illustrated embodiment, the first plurality of ribs 174 includes four ribs on each side of the toilet seat 18. In some embodiments, the first plurality of ribs 174 may include fewer or more than four ribs on each side. The first plurality of ribs 174 is configured to provide structural rigidity to the ring 70 and each wing 74, 78 and support the toilet seat 18 when in the lowered position. The second plurality of ribs 178 is formed along the bottom surface 86 of the ring 70 at the front portion of the toilet seat assembly 10. The second plurality of ribs 178 extends from the inner perimeter 94 of the ring 70 to the outer perimeter 90 of the ring 70. In the illustrated embodiment, the second plurality of ribs 178 includes five ribs. In some embodiments, the second plurality of ribs 178 may include fewer or more than five ribs. The toilet seat assembly 10 further includes a third plurality of ribs or transverse ribs 182 to provide further structural rigidity. In the illustrated embodiment, the transverse ribs 182 are formed by two curved ribs respectively extending along the juncture 102 between the ring 70 and each wing 74, 78. Specifically, the transverse ribs 182 extend transversely through the first plurality of ribs 174, from the connecting edge 102 to a rear edge 186 (FIG. 4) of the toilet seat 18. The transverse ribs 182 also define a boundary of the toilet seat 18 without the wings 74, 78.

As illustrated in FIG. 5, the first and second plurality of ribs 174, 178 extend beyond the bottom surface 86 of the ring 70 toward the toilet 14. As such, the first and second plurality of ribs 174, 178 are configured to engage the toilet 14 when the toilet seat 18 is in the lowered position. In addition, the first and second plurality of ribs 174, 178 each extend along a different direction radiating from a common point 184 located within the opening 98 of the toilet seat 18. Each of the ribs 174, 178 is thereby linear. In other embodiments, some or all of the ribs 174, 178 may be non-linear (e.g., curved, irregular, etc.).

Although the invention has been described with reference to certain embodiments, variations and modifications exist within the spirit and scope of the invention. Various features of the invention are set forth in the following claims.

What is claimed is:

1. A toilet seat assembly for a toilet, the toilet seat assembly comprising:

a hinge post configured to be coupled to the toilet;

a toilet seat rotatably coupled to the hinge post and defining a bottom surface that is configured to face the toilet, the toilet seat including a ring having a support surface opposite the bottom surface and configured to support a person when sitting on the toilet, a first wing extending from a first side of the ring, and a second wing extending from a second side of the ring opposite the first side;

a first handle extending upwardly from the first wing and oriented perpendicularly relative to the bottom surface of the toilet seat; and a second handle extending upwardly from the second wing and oriented perpendicularly relative to the bottom surface of the toilet seat, wherein the first and second handles are configured to be gripped by the person, wherein each of the first and second wings includes a rear portion adjacent the hinge post and a front portion opposite the rear portion, and wherein each of the first and second handles includes a first loop and a second loop, and wherein the second loop of each handle is adjacent the front portion of the corresponding wing.

2. The toilet seat assembly of claim 1, wherein the toilet seat is formed of a first material, wherein the first and second handles are formed of a second material, and wherein the second material is more rigid than the first material.

3. The toilet seat assembly of claim 2, wherein each of the first and second handles includes a gripping member formed of a third material that is softer than the second material.

4. The toilet seat assembly of claim 1, wherein the bottom surface of the toilet seat is planar.

5. The toilet seat assembly of claim 1, wherein each wing defines a wing thickness extending between the bottom surface and a top surface of each wing, and wherein the wing thickness increases in a direction extending away from the ring of the toilet seat.

6. The toilet seat assembly of claim 5, wherein the ring defines a ring thickness extending between the bottom surface and the support surface of the ring, and wherein the wing thickness is substantially equal to the ring thickness along junctures where the ring connects to the first and second wings.

7. The toilet seat assembly of claim 1, wherein each of the first and second handles further includes a grip portion that is disposed on the first loop.

8. The toilet seat assembly of claim 7, wherein the grip portion of each handle defines a cavity, and wherein the cavity is configured to receive a gripping member.

9. The toilet seat assembly of claim 1, wherein at least a portion of the first loop and the second loop each defines a T-shaped cross section.

10. The toilet seat assembly of claim 1, wherein the first wing includes a first pair of bores and the second wing includes a second pair of bores, wherein the first handle is coupled to the first pair of counterbores via a first snap-fit mechanism and the second handle is coupled to the second pair of bores via a second snap-fit mechanism.

11. A toilet seat assembly for a toilet, the toilet seat assembly comprising:

a hinge post configured to be coupled to the toilet;

a toilet seat rotatably coupled to the hinge post and defining a bottom surface that is configured to face the toilet, the toilet seat including a ring having a support surface opposite the bottom surface and configured to support a person when sitting on the toilet, an outer perimeter, and an inner perimeter defining an opening, a first wing integrally formed with the ring, the first wing extending from the outer perimeter of the ring on a first side of the ring, and a second wing integrally formed with the ring, the second wing extending from the outer perimeter of the ring on a second side of the ring opposite the first side;

a first handle coupled to the first wing and configured to be gripped by the person;

a second handle coupled to the second wing and configured to be gripped by the person; and a plurality of ribs formed on the bottom surface of the toilet seat to provide support to the toilet seat.

12. The toilet seat assembly of claim 11, wherein the plurality of ribs is a first plurality of ribs extending continuously between the inner perimeter of the ring and an outer edge of each wing, the toilet seat assembly further comprising a second plurality of ribs extending between the inner perimeter of the ring and the outer perimeter of the ring.

13. The toilet seat assembly of claim 12, further comprising transverse ribs formed along junctures where the ring connects to the first and second wings, wherein the transverse ribs extend transversely through the first plurality of ribs.

14. The toilet seat assembly of claim 11, wherein the plurality of ribs each extends along a different direction radiating from a common point located within the opening.

15. A toilet seat assembly for a toilet, the toilet seat assembly comprising:

a hinge post configured to be coupled to the toilet;

a toilet seat rotatably coupled to the hinge post and defining a bottom surface that is configured to face the toilet, the toilet seat including a ring having a support surface opposite the bottom surface and configured to support a person when sitting on the toilet, a first wing extending from a first side of the ring, the first wing having a rear portion adjacent the hinge post and a front portion opposite the rear portion, and a second wing extending from a second side of the ring, the second wing having a rear portion adjacent the hinge post and a front portion opposite the rear portion;

a first handle coupled to the first wing and configured to be gripped by the person; and a second handle coupled to the second wing and configured to be gripped by the person, wherein at least a portion of the first handle extends beyond the front portion of the first wing, and wherein at least a portion of the second handle extends beyond the front portion of the second wing, and wherein at least a portion of the first and second handles defines a T-shaped cross section.

16. The toilet seat assembly of claim 15, wherein the first wing includes a first pair of bores and the second wing includes a second pair of bores, wherein the first handle includes posts that are received within the first pair of bores, and wherein second handle includes posts that are received within the second pair of bores.

17. The toilet seat assembly of claim 16, wherein the first handle is coupled to the first pair of bores via a first snap-fit mechanism and the second handle is coupled to the second pair of bores via a second snap-fit mechanism.

18. The toilet seat assembly of claim 15, wherein each of the first and second handles includes a grip portion defining a cavity that faces the support surface, and wherein each cavity is configured to receive a gripping member formed of a softer material than the grip portion.

19. A toilet seat assembly for a toilet, the toilet seat assembly comprising:

a hinge post configured to be coupled to the toilet;

a toilet seat rotatably coupled to the hinge post and defining a bottom surface that is configured to face the toilet, the toilet seat including a ring having a support surface opposite the bottom surface and configured to support a person when sitting on the toilet, a first wing extending from a first side of the ring, the first wing having a rear portion adjacent the hinge post and a front portion opposite the rear portion, and a second wing extending from a second side of the ring, the second wing having a rear portion adjacent the hinge post and a front portion opposite the rear portion;

a first handle coupled to the first wing and configured to be gripped by the person; and a second handle coupled to the second wing and configured to be gripped by the person, wherein at least a portion of the first handle extends beyond the front portion of the first wing, wherein at least a portion of the second handle extends beyond the front portion of the second wing, wherein each of the first and second handles includes a grip portion defining a cavity that faces the support surface, and wherein each cavity is configured to receive a gripping member formed of a softer material than the grip portion.

* * * * *